US009979108B2

(12) United States Patent
Hsu

(10) Patent No.: US 9,979,108 B2
(45) Date of Patent: May 22, 2018

(54) ELECTRICAL CONNECTOR ASSEMBLY AND MODULE SPACER THEREOF

(71) Applicant: FOXCONN INTERCONNECT TECHNOLOGY LIMITED, Grand Cayman (KY)

(72) Inventor: Shuo-Hsiu Hsu, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

(21) Appl. No.: 15/438,786

(22) Filed: Feb. 22, 2017

(65) Prior Publication Data

US 2017/0244185 A1 Aug. 24, 2017

(30) Foreign Application Priority Data

Feb. 24, 2016 (TW) ..... 105202584 U

(51) Int. Cl.
*H01R 12/71* (2011.01)
*H01R 12/70* (2011.01)

(52) U.S. Cl.
CPC ..... *H01R 12/716* (2013.01); *H01R 12/7017* (2013.01); *H01R 12/7076* (2013.01)

(58) Field of Classification Search
CPC ..... H01R 12/52; H01R 12/57; H01R 12/62; H01R 12/714; H01R 12/79; H01R 13/24; H01R 12/592; H01R 12/721; H01R 13/2442; H01R 13/40; H01R 13/627; H01R 2103/00; H01R 43/26; H01R 12/7076; H01R 13/07
See application file for complete search history.

(56) References Cited

U.S. PATENT DOCUMENTS 4,195,193 A * 3/1980 Grabbe ..... H01L 23/047 174/261
4,504,105 A * 3/1985 Barkus ..... H05K 7/1069 439/331
5,438,481 A * 8/1995 Murphy ..... H01L 23/495 257/E23.031
5,901,048 A * 5/1999 Hu ..... H01L 23/562 257/725
6,957,967 B2 * 10/2005 Petersen ..... H01R 13/2435 439/330
9,541,718 B2 * 1/2017 Ogura ..... G02B 6/428
2009/0142956 A1 * 6/2009 Ma ..... H01L 23/4006 439/485
2010/0055939 A1 * 3/2010 Hsu ..... H01R 12/88 439/73

(Continued)

FOREIGN PATENT DOCUMENTS

CN 104852174 A 8/2015
CN 204632965 U 9/2015

*Primary Examiner* — Truc Nguyen
(74) *Attorney, Agent, or Firm* — Wei Te Chung; Ming Chieh Chang

(57) ABSTRACT

The electrical connector assembly includes an electrical connector and a module spacer. The electrical connector is installed on a circuit board and defines a mating space. The module spacer includes a cover covering on the mating space in a vertical direction and four side walls extending downwardly from the cover. The cover and the side walls defines a receiving space for retaining the electrical connector. The side walls are supported on the circuit board.

16 Claims, 5 Drawing Sheets

(56) References Cited

U.S. PATENT DOCUMENTS

| | | | | |
|---|---|---|---|---|
| 2011/0207344 | A1* | 8/2011 | McColloch | G02B 6/3885 439/78 |
| 2014/0011386 | A1* | 1/2014 | Braunlich | H01R 13/6456 439/350 |
| 2014/0235098 | A1* | 8/2014 | Hsu | H05K 7/1007 439/577 |
| 2014/0315400 | A1* | 10/2014 | Hsu | H01R 12/707 439/83 |
| 2014/0364002 | A1* | 12/2014 | Hsu | H01R 13/645 439/374 |
| 2015/0229063 | A1* | 8/2015 | Hsu | H05K 7/1061 439/136 |

* cited by examiner

ELECTRICAL CONNECTOR ASSEMBLY AND MODULE SPACER THEREOF

BACKGROUND OF THE INVENTION

1. Field of the Invention

The present invention relates to an electrical connector assembly and a module spacer there of, and particularly to an electrical connector secured in the module spacer.

2. Description of Related Art

Chinese Patent No. CN204632965 discloses an electrical connector assembly having a circuit board and at least two first connectors pre-mounted on the circuit board. The electrical connector also includes at least one chip module installed on the first connectors. The storage of the electrical connector can be expanded simply by selectively mounting another chip module on one of the first connectors. However, the height of the first connector with a chip module must be higher than the one without a chip module. When mounting a heat sink on the electrical assembly, the first connector without a chip module mounted thereon may be damaged easily.

Therefore, an improved connector which can avoid damaging the first connector is desired.

SUMMARY OF THE INVENTION

Accordingly, an object of the present invention is to provide an electrical connector assembly including an electrical connector and a module spacer. The electrical connector is installed on a circuit board and defines a mating space. The module spacer includes a cover covering on the mating space in a vertical direction and four side walls extending downwardly from the cover. The cover and the side walls defines a receiving space for retaining the electrical connector. The side walls are supported on the circuit board. The module spacer could protect the electrical connector from damaging by a heat sink.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
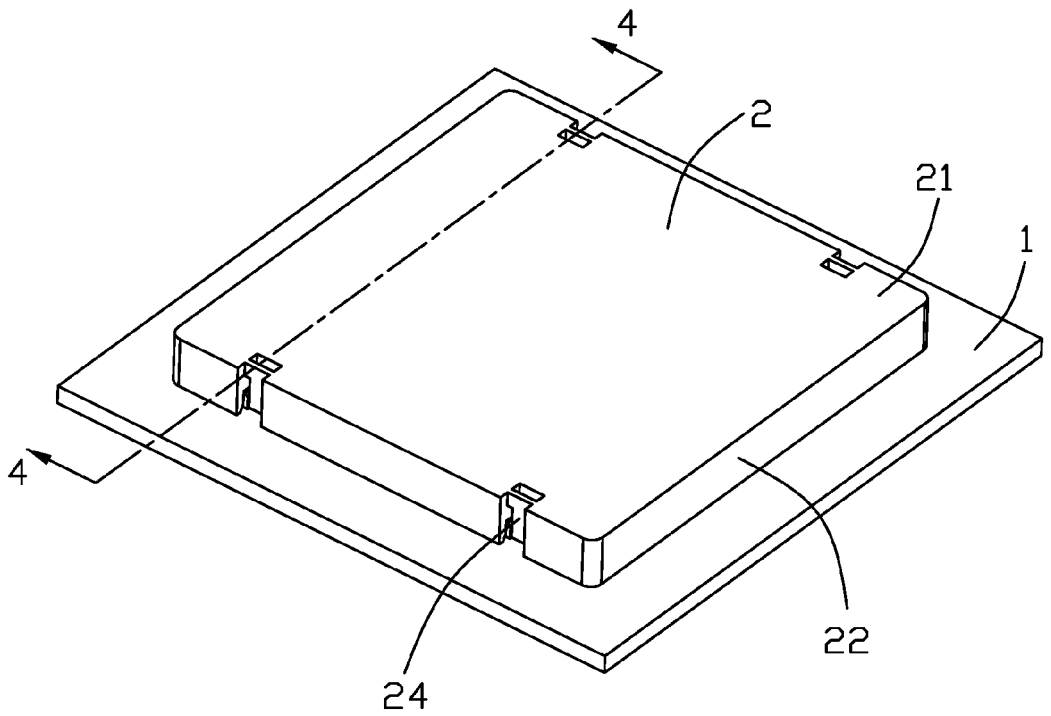
FIG. 1 is an assembled perspective view of an electrical connector assembly according to the presently preferred embodiment of the invention.
Figure 2:
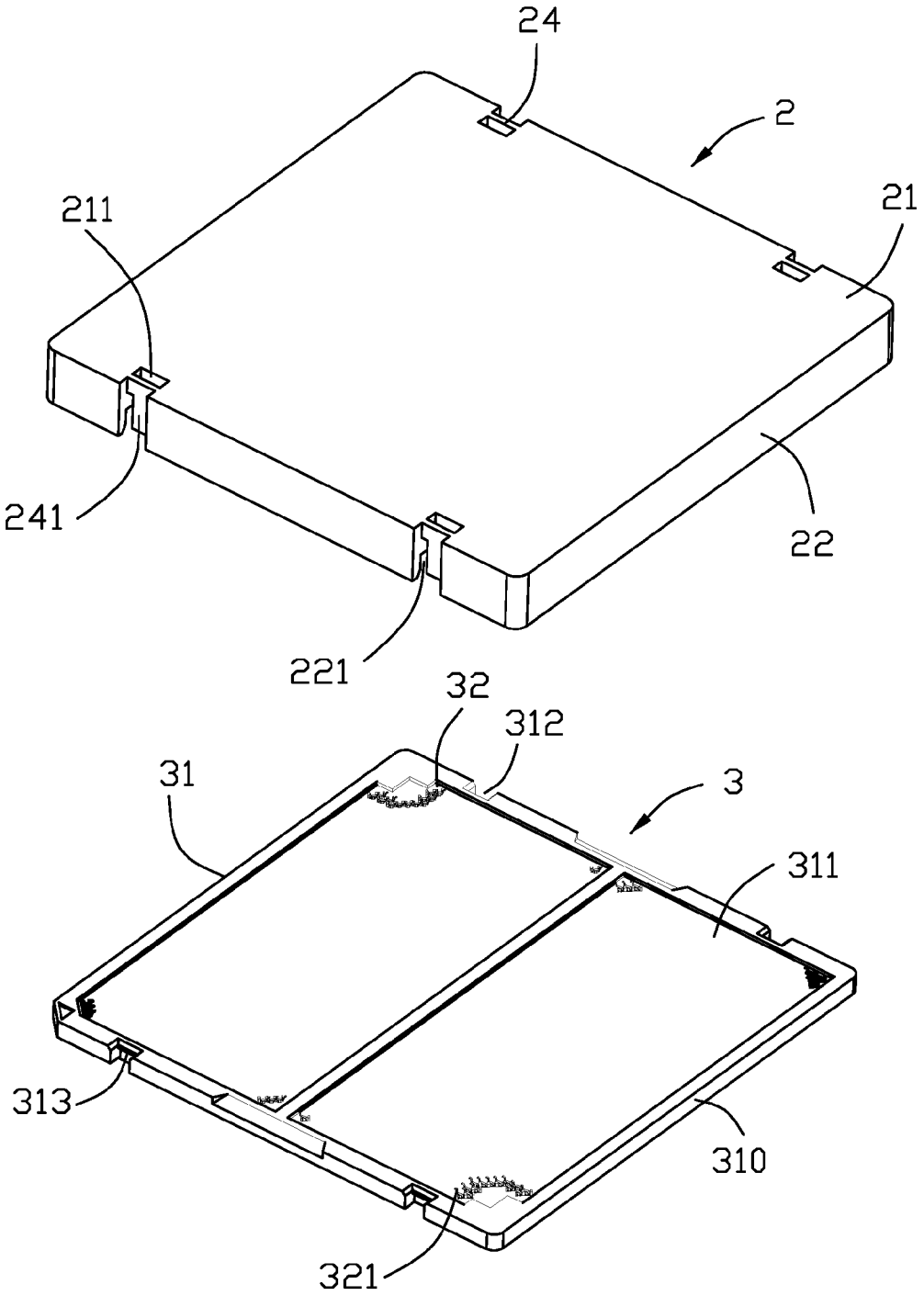
FIG. 2 is a downwardly exploded perspective view of the electrical connector assembly of FIG. 1.
Figure 3:
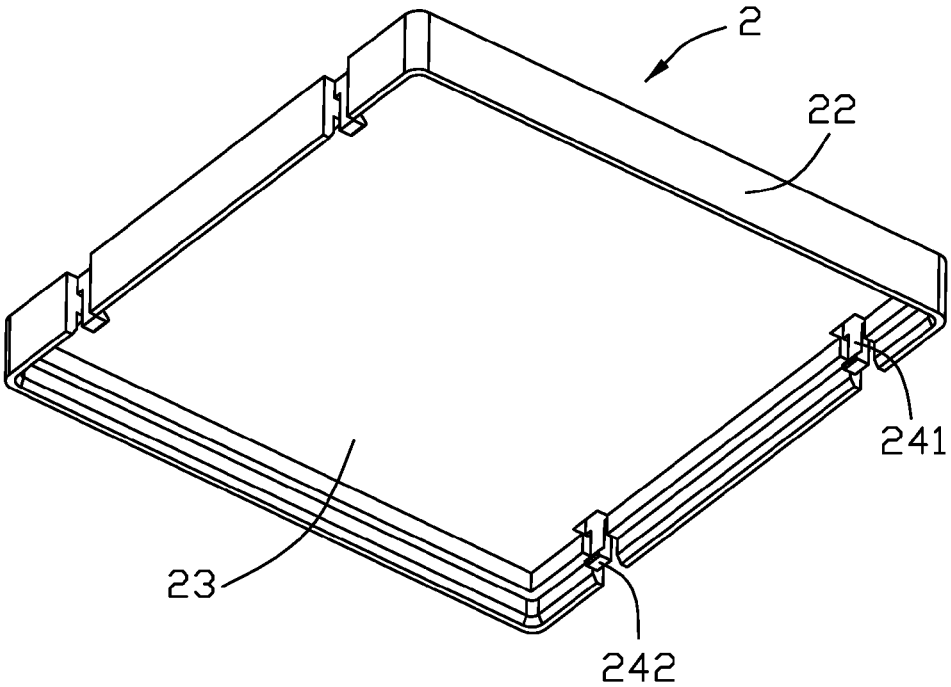
FIG. 3 is an upwardly exploded perspective view of the electrical connector assembly of FIG. 1.
Figure 3:
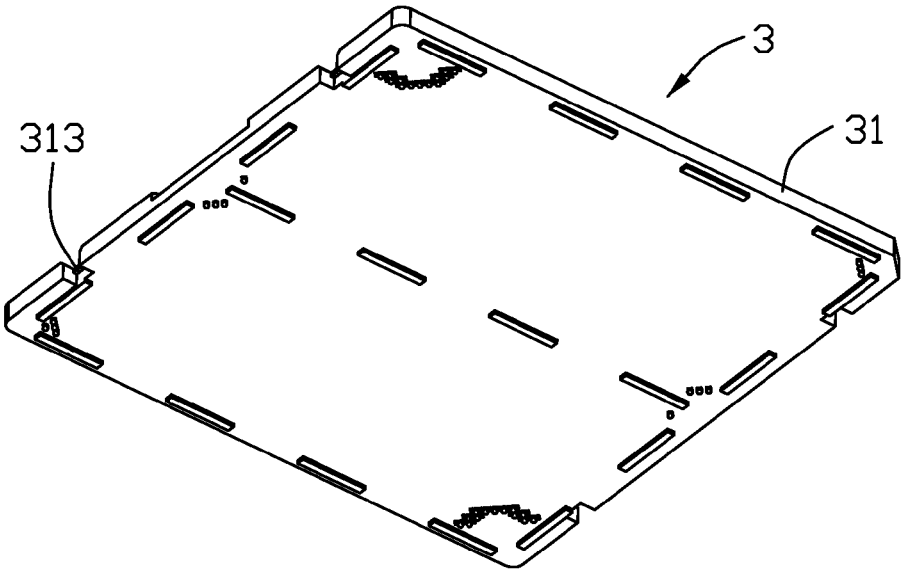
Figure 4:
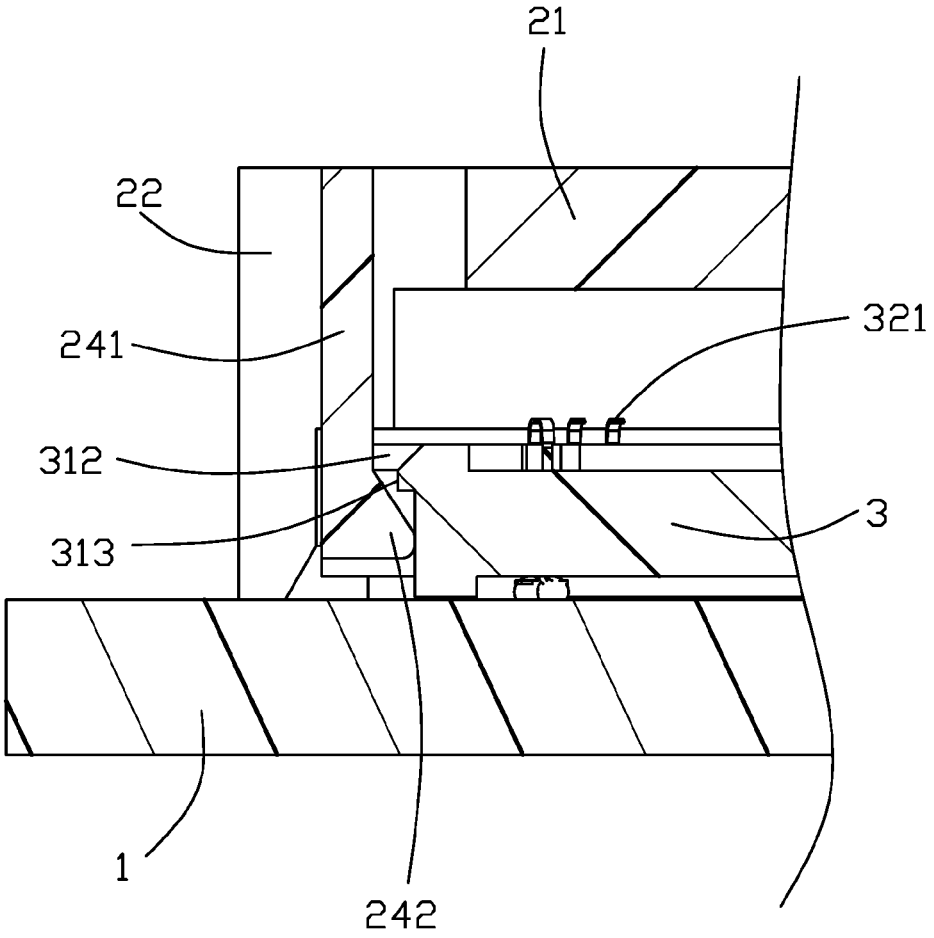
FIG. 4 is a cross-sectional view of the electrical connector assembly of FIG. 1.

Referring to FIGS. 1-3, an electrical connector assembly includes an electrical connector 3 mounted on a circuit board 1 and a module spacer 2 for retaining the electrical connector 3.

Referring to FIG. 2 and FIG. 3, the spacer 2 includes a cover 21 extending transversely, four side walls 22 extending downwardly from the cover 21, a receiving space 23 defined by the cover 21 and the side walls 22, and four latches 24 extending from the cover 21 into the receiving space 23. Each of the latches 24 has a connecting portion 241 extending downwardly form the cover 21 and a hook 242 extending from the connecting portion 241 into the receiving space 23. The cover 21 of the module spacer 2 covers on the receiving space 23 in a vertical direction and includes at least two holes 211 neighboured to the connecting portion 241. The module spacer 2 further comprises four notches 221 located in two opposite side walls 22 for receiving the latches 24. The latches 24 can be fixed with the electrical connector 3 flexibly as the holes 211 of the cover 21 and the notches 221.

The electrical connector 3 is retained in the receiving space 23. The electrical connector 3 includes an insulative housing 31 and a plurality of terminals 32 retained in the insulative housing 31. The insulative housing 31 includes four frames 310 and a mating space 311 defined by the frames 310. The insulative housing 31 further includes four holding portions 312 engaged with the latches 24 of the module spacer 2. Each of the holding portions 312 includes a barrier 313 and a cavity located under the barrier 313 for receiving the hook 242. Each of the terminals 32 has a contacting section 321 extending into the mating space 311. The cover 21 of the module spacer 2 covers on the mating space 311 for protecting the electrical connector 3.

Figure 5:
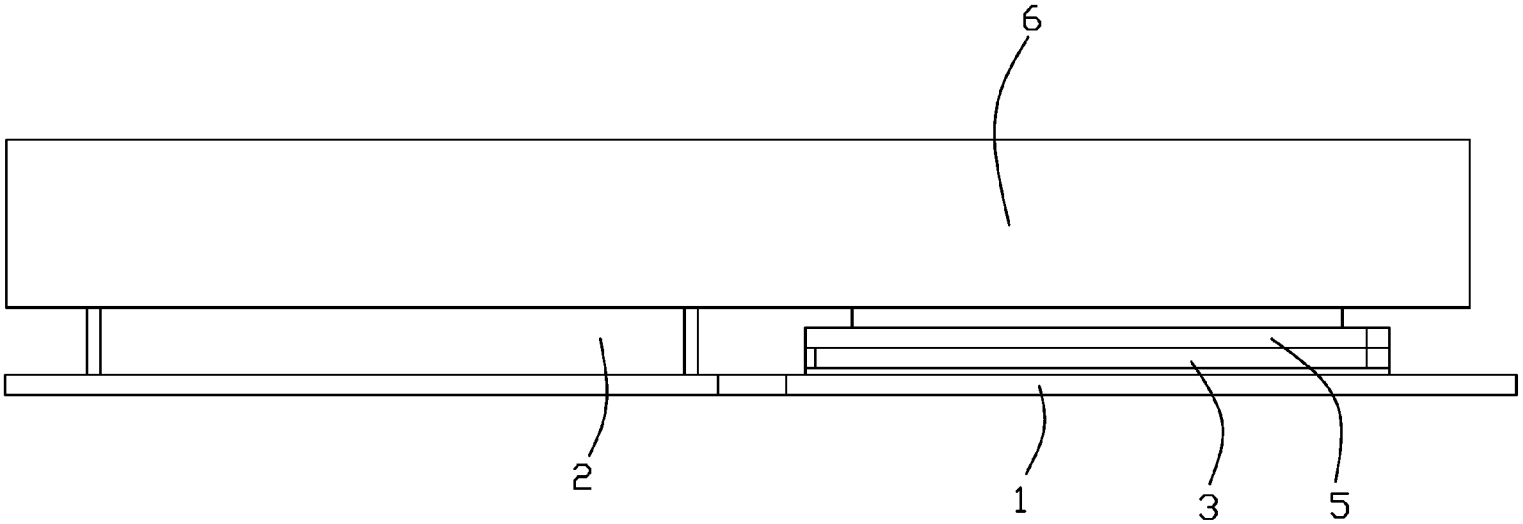
FIG. 5 is a side view of the electrical connector assembly of FIG. 1 used with another same type connector which is mounted upon the same printed circuit board with the chip module loaded therein.

Referring to FIG. 5, the electrical connector 3 is retained in the module spacer 2. A gap is formed between the contacting sections 321 of the terminals 32 and the cover 21 of the module spacer 2 in order to protect the electrical connector 3. The side walls 22 are supported by the circuit board 1. The latches 24 are engaged with the holding portions 312. The hook 242 of the latches 24 is retained in the cavity of the holding portion 312 and a gap is located between the part of the hook 242 retained in the cavity and the barrier 313 of the holding portion 312. The height of the part of the hook 242 retained in the cavity of the holding portion 312 is smaller than the height of the cavity in the vertical direction so that the electrical connector 3 can move up and down in a small range for adjusting the manufacturing tolerance of the electrical connector 3.

As shown in FIG. 5, a chip module 5 can be mounted on the electrical connector 3. The overall/total height of the chip module 5 mounted on the electrical connector 3 is the same as the height of the module spacer 2 in the vertical direction so that the electrical connector 3 without the loaded chip module 5 can be protected well when a heat sink 6 seated upon the chip module 5, which is loaded in the neighboring connector 3, to remove the corresponding heat. Then, the cover 21 of the module spacer 2 covering on the mating space 313 in the vertical direction can prevent dust from falling in such an empty electrical connector 3. In brief, the module spacer 2 with dual functions may not only cover the empty connector 3 for dust-prevention and impact-protection, but also provide the support for the heat sink 6 which is required to be intimately positioned upon the chip module 5 located in a neighboring connector 3 for heat transfer consideration.

However, the disclosure is illustrative only, changes may be made in detail, especially in matter of shape, size, and arrangement of sections within the principles of the invention.

What is claimed is:

1. An electrical connector assembly comprising:

an electrical connector installed on a circuit board and defining a mating space; and a module spacer comprising a cover and four side walls extending downwardly therefrom;

wherein the cover and the side walls of the module spacer define a receiving space for receiving the electrical connector and the cover is located upon the mating space in a vertical direction, and the side walls of the module spacer are supported on the circuit board;

wherein the module spacer comprises four latches extending into the receiving space and fixed with the electrical connector, and each of the latches comprises a connecting portion extending downwardly from the cover having a hole neighbored to the connecting portion.

2. The electrical connector assembly as claimed in claim 1, wherein the electrical connector comprises an insulative housing having the mating space and a plurality of terminals retained in the insulative housing, each of the terminals comprises a contacting section extending into the mating space, and a gap is formed between the contacting sections of the terminals and the cover of the module spacer.

3. The electrical connector assembly as claimed in claim 1, wherein the module spacer further comprises four notches located in two opposite side walls for receiving the latches.

4. The electrical connector assembly as claimed in claim 1, wherein the electrical connector comprises four holding portions engaged with the latches, respectively.

5. The electrical connector assembly as claimed in claim 4, wherein each of latches has a hook extending from the connecting portion into the receiving space, and each of the holding portions has a barrier and a cavity under the barrier for receiving the hook.

6. The electrical connector assembly as claimed in claim 5, wherein the height of the part of the hook retained in the cavity is smaller than the height of the cavity in the vertical direction, and a gap is located between the part of the hook retained in the cavity and the barrier.

7. The electrical connector assembly as claimed in claim 1, further comprising at least one chip module mounted on the electrical connector, the overall height of the chip module mounted on the electrical connector is the same as the height of the module spacer.

8. A module spacer for protecting an electrical connector mounted on a circuit board, comprising:

a cover;

four side walls extending downwardly from the cover and supported on the circuit board; and at least two latches fixed with the electrical connector;

wherein the cover and four side walls define a receiving space for receiving the electrical connector, and the cover of the module spacer covers on the receiving space in a vertical direction;

wherein the module spacer comprises four latches extending into the receiving space and fixed with the electrical connector, and each of the latches comprises a connecting portion extending downwardly from the cover having a hole neighbored to the connecting portion.

9. The module spacer as claimed in claim 8, further comprising four notches located in two opposite side walls for receiving the latches.

10. An electrical connector system comprising:

a printed circuit board;

two same type connectors side by side mounted upon the printed circuit board, each of said connectors including an insulative housing with a mating space therein for receiving a chip module, a plurality of contacts disposed in the housing with contacting sections upwardly extending into the mating space;

one of the connector being loaded with one chip module while the other not but empty;

a module spacer being mounted upon the printed circuit board to enclose the empty connector; and a heat sink being seated upon both the module spacer and the chip module without tilting for removal of heat generated by the chip module.

11. The electrical connector assembly as claimed in claim 10, wherein a height of the module spacer is equal to a sum of a height of the connector and that of the chip module.

12. The electrical connector assembly as claimed in claim 10, wherein the module spacer is equipped with thereon resilient latches to roughly confront the housing for preventing inadvertent upward withdrawal therefrom.

13. The electrical connector assembly as claimed in claim 12, wherein each latch forms an upward tapered surface for easy withdrawal from the housing.

14. The electrical connector assembly as claimed in claim 12, wherein the housing forms upward tapered surfaces to confront the corresponding latches, respectively, for easy loading the module spacer above the empty connector.

15. The electrical connector assembly as claimed in claim 10, wherein no downward faces of the module spacer intimately press upper faces of the housing so that no downward force derived from the module spacer is applied upon the connector.

16. The electrical connector assembly as claimed in claim 10, wherein said module spacer includes a plurality of side walls extending downwardly from a cover to commonly form a receiving space in which the empty connector therein.

* * * * *